United States Patent [19]

Patty

[11] 4,377,245

[45] Mar. 22, 1983

[54] CLOSURE FOR CONTAINER

[76] Inventor: Blyde L. Patty, 12 Yolo Dr., Prescott, Ariz. 86301

[21] Appl. No.: 219,934

[22] Filed: Dec. 24, 1980

Related U.S. Application Data

[63] Continuation-in-part of Ser. No. 194,419, Oct. 6, 1980.

[51] Int. Cl.[3] ..... B65D 43/18

[52] U.S. Cl. ..... 220/336; 220/319; 220/321; 220/378; 215/274

[58] Field of Search ..... 220/319, 320, 321, 336, 220/378; 215/274, 275; 292/256.6

[56] References Cited

U.S. PATENT DOCUMENTS

| | | | |
|---|---|---|---|
| 2,319,145 | 5/1943 | Loomis | 220/336 X |
| 4,176,756 | 12/1979 | Gellman | 215/274 |
| 4,279,358 | 7/1981 | Jacobs | 220/321 |

*Primary Examiner*—George T. Hall

*Attorney, Agent, or Firm*—Drummond, Nelson & Nissle

[57] ABSTRACT

A closure for sealing an opened container. The closure includes a pair of rigid members pivotally interconnected at a point on the periphery thereof for movement between at least two operative positions, a closed position with the members forming a generally circular top, each member having a face adjacent to an opposing face of the other member when the members are in the closed position, and an open position with the members rotated apart about the pivot point; a rigid collar member along an outer edge of each pivotally interconnected member, the outer edges generally defining the periphery of the circular top when the pivotally interconnected members are in the closed position; the inner surface of each collar member being adapted to sealingly engage the container when the pivotally interconnected members are in the closed position; and, a latch for securing the pivotally interconnected members in the closed position about the top of the container.

1 Claim, 16 Drawing Figures

CLOSURE FOR CONTAINER

This application is a Continuation-In-Part of my prior co-pending application for "CLOSURE FOR CONTAINER", Ser. No. 194,419, filed Oct. 6, 1980.

This invention relates to a closure for sealing open containers.

More particularly, the instant invention relates to a closure which can, with the application of a minimal amount of hand strength, be readily attached to and removed from a container.

In another and more specific respect, the invention pertains to a closure which is readily disassembled for storage and cleaning and for the replacement of elastic seals contained therein.

In a further respect, the invention pertains to a closure which will seal a moderately pressurized conventional beverage can.

Aluminum and steel cans have been long utilized for the packaging and marketing of soft drinks and alcoholic beverages. Often, particularly when a larger volume can has been opened, an individual will not consume all of the beverage in the can and will place the opened container in a refrigerator for temporary storage. Unfortunately, over a fairly short period of time the carbonation escapes and the beverage becomes flat and unpalatable. The drink is then discarded.

A variety of closure devices for wide-mouthed containers are known in the art. For instance, see U.S. Pat. Nos. 382,547 to Chellis, 829,638 to Dodge, 1,080,366 to Pick, 2,484,270 to Coyle and 3,834,572 to Eskenazi. However, in contrast to the wide spectrum of convenient closure devices which have been developed for glass beverage bottles, an inexpensive readily utilized sealing device for beverage cans has apparently not been developed and successfully marketed.

The closure illustrated in U.S. Pat. No. 3,834,572 to Eskenazi exemplifies some of the disadvantages inherent in prior art sealing devices. The continuous inner ridged surface of the Eskenazi cap is constructed from resilient elastic materials. Many elastic materials tend to "grab" or adhere to the surface of another material. This, in addition to the need to force fit the cap into position by downwardly forcing the inner ridged surfaces of the cap over the rim of a container so that the rim "snaps" into position in the receiving groove formed near the top of the inner surface, makes frequent use of the Eskenazi device inconvenient, especially for an individual suffering from arthritis or other disabling muscle and bone diseases of the hands and arms. Sticky beverage deposits which form and accumulate on the inner surfaces of the cap aggravate this problem.

Another disadvantage of the Eskenazi closure is that once an elastic element comprising the device wears out or is damaged, the entire cap must be discarded. The cap is not readily repaired. Also, cleaning the interior grooves and surface perforations of the Eskenazi device can be, because of the relatively constricted space defined by the cap interior, awkward.

Accordingly, it would be highly desirable to provide an improved closure which could, with the expenditure of a minimal amount of hand strength, be conveniently attached to and removed from a wide-mouthed container.

It would also be highly desirable to provide an improved closure which could be readily disassembled for cleaning and for the repair of elastic members contained therein.

Therefore, it is a principal object of the invention to provide an improved closure for sealing open containers.

Another object of the present invention is to provide a closure which can, with the application of minimal hand and arm strength, be quickly attached to and removed from a container.

A further object of the instant invention is to provide a closure which can be easily disassembled for cleaning and for the replacement of elastic elements contained therein.

Still another and further object of the instant invention is to provide a kit for the construction of a closure which contains parts which may be assembled to form closures adaptable to various kinds of containers.

These and other, further and more specific objects and advantages of the invention will be apparent to those skilled in the art from the following detailed description thereof, taken in conjunction with the drawings, in which.

Briefly, in accordance with my invention, I provide a closure for detachably fixedly engaging and sealing an open container. Said closure comprises a pair of substantially rigid members pivotally interconnected at a point on the periphery thereof for movement between at least two operative positions, a closed position with said members forming a generally circular top, each member having a face adjacent to an opposing face of the other member when the members are in a closed position, an open position with the members rotated apart about the pivot point; a projecting depending substantially rigid collar member along an outer edge of each of the members, the outer edges generally defining the periphery of the circular top when the pivotally connected members are in a closed position, the inner surface of each of the collar members being adapted to sealingly engage the container when the pivotally connected members are in a closed position; and, means for securing the pivotally connected members in a closed position about the container.

Figure 1:
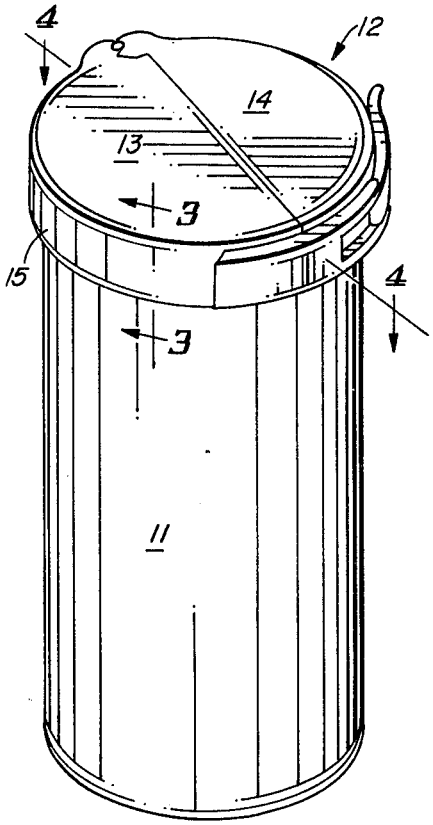
FIG. 1 is a perspective view of a conventional beverage container with a closure embodying the principles of the present invention affixed thereto.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a conventional beverage container 11 with a closure, generally indicated by reference character 12, having panel members 13, 14 respectively provided with downwardly projecting collar members 15, 16 and pivotally interconnected by hinge 17. The pin in hinge 17 is removable so that members 13, 14 may be readily disconnected from one another. As shown in FIGS. 2–5, the inner surfaces of collar members 15, 16 are respectively provided with elongate resilient bands 18, 19. Circumferential grooves 20, 21 receive the edges of and allow bands 18, 19 to be inserted in and removed from collar members 15, 16.

Figure 5:
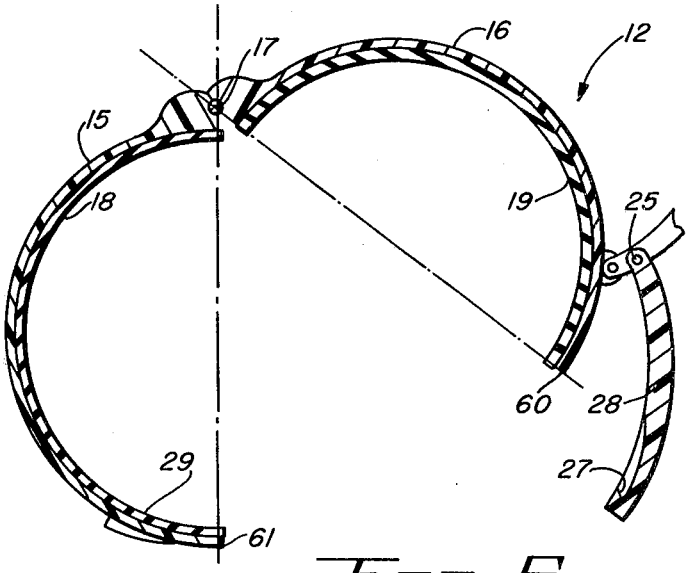
FIG. 5 is a sectional view of the closure of FIG. 1 illustrating the mode of operation thereof.

Latch member 23 is pivotally attached to collar 16 by hinge 24. Member 28 is pivotally connected to latch 23 by pin 25 and has slot 26 formed therein. When, as shown in FIGS. 1 and 5, members 13, 14 are closed, and surface 27 of slot 26 engages upstanding tooth 29, depressing latch 23 toward collar 16 compresses elastic member 30 on face 31 of panel 13 into groove 32 formed in face 33 of panel 14.

Figure 2:
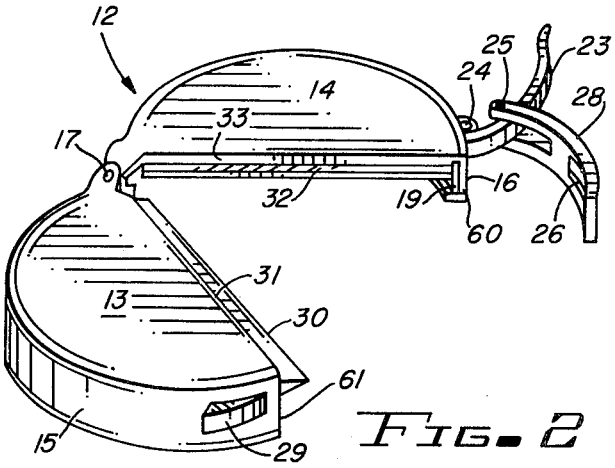
FIG. 2 is a perspective view of the closure of FIG. 1 illustrating further details thereof.
Figure 3:
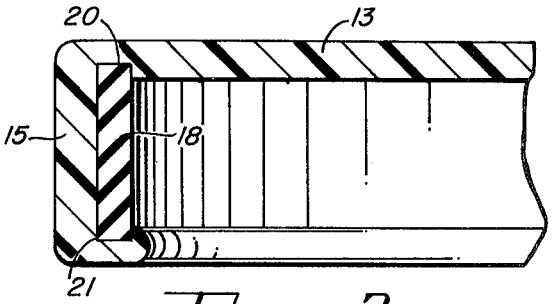
FIG. 3 is a partial sectional view of the closure of FIG. 1 taken along section line 3—3 thereof.
Figure 4:
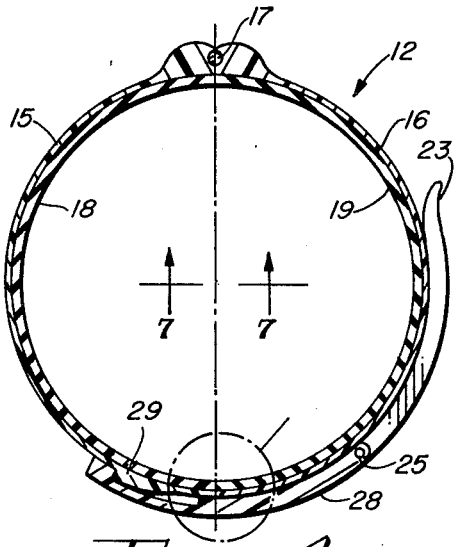
FIG. 4 is a sectional view of the closure of FIG. 1 taken along section line 4—4 thereof.

As illustrated by abutting slot 32 and seal 19 in FIG. 2, slot 32, seal 30 and seals 19, 18 are integrally designed such that a complete and continuous seal is formed over and around the upper portion of the container within closure 12 when panel and collar members 13, 14, 15, 16 are secured on the top of container 11 by depressing latch 23.

Figure 7:
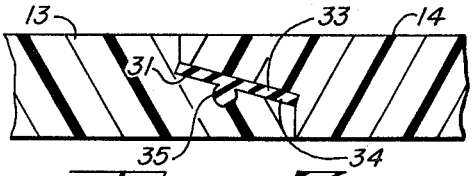
FIG. 7 is a sectional view of the closure of FIG. 4 taken along section line 7—7 thereof and illustrating the sealing engagement of the two pivoting members of the closure.
Figure 6:
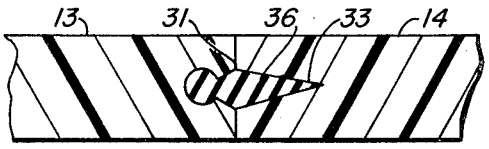
FIG. 6 is a sectional view of the closure of FIG. 1 illustrating an alternate construction for providing sealing engagement between the two pivoting members of the closure.
Figure 8:
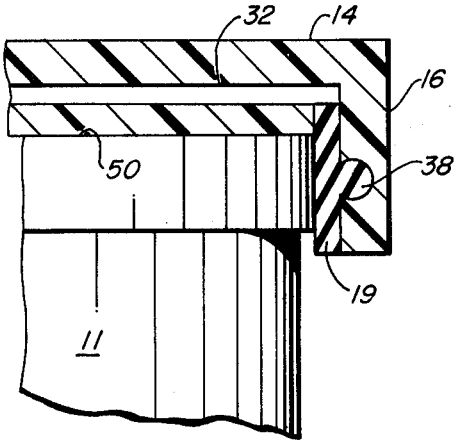
FIG. 8 is a partial sectional side view of the container and closure of FIG. 1.

FIGS. 6 and 7 depict alternate constructions for sealing the space remaining between opposing faces 31 and 33 when panels 13, 14 are pivoted into the closed position of FIG. 1. In FIG. 7 elongate band 34 is positioned on face 31 by snapping depending lip 35 into a receiving groove formed in face 31. When latch 23 is depressed, the angled portions of faces 31 and 33 sealingly compress resilient band 34. The wedge shaped resilient seal 36 of FIG. 6 is similarly anchored by snapping lip 37 into a groove formed in face 31. Likewise, as shown in FIG. 8, bands 18, 19 may be affixed by pressing circular lip 38 into a groove formed in collars 15, 16.

Figure 9:
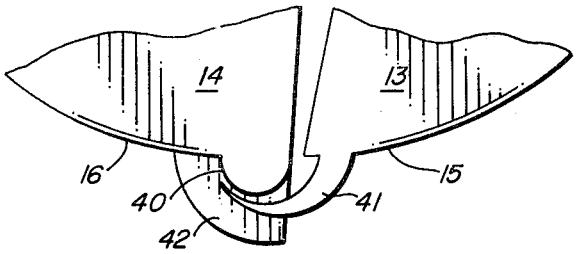
FIG. 9 is a top view particularly illustrating an alternate construction for detachably pivotally connecting the two members of the closure.
Figure 10:
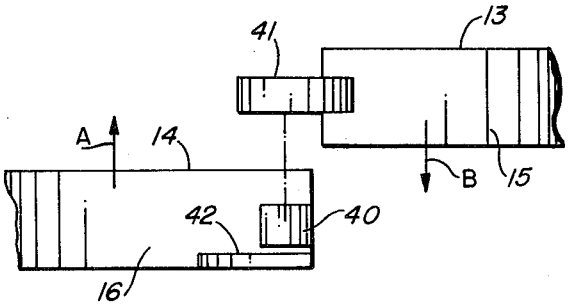
FIG. 10 is a partial side view illustrating the assembly of the closure members of FIG. 9.

An optional hinge construction for pivotally connecting panel members 13, 14 is illustrated in FIGS. 9 and 10 and includes knob 40 integrally formed on collar 16. Knob 40 is pivotally enclosed by finger 41 projecting from collar 15. The hinge is assembled by displacing panel members 13 and 14 in the directions of arrows A and B. Guard member 42 stops the downward travel of finger 41.

Figure 11:
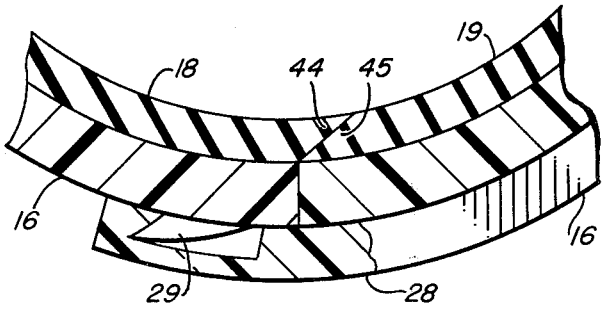
FIG. 11 is an enlarged view of a portion of the closure of FIG. 4.
Figure 12:
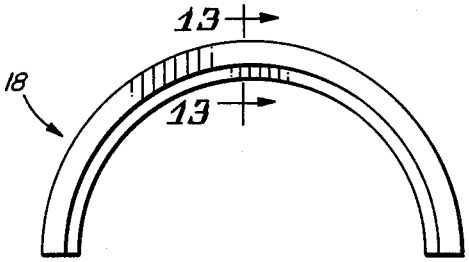
FIG. 12 is a top view of an optional elastic seal which may be utilized in combination with the closure member of FIG. 1.
Figure 13:
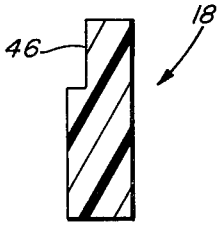
FIG. 13 is a sectional view of the seal of FIG. 12 taken along section line 13—13 thereof.
Figure 15:
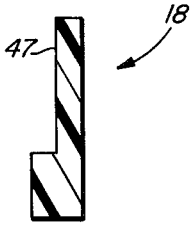
FIG. 15 is a sectional view of the seal of FIG. 14 taken along section line 14—14 thereof.
Figure 14:
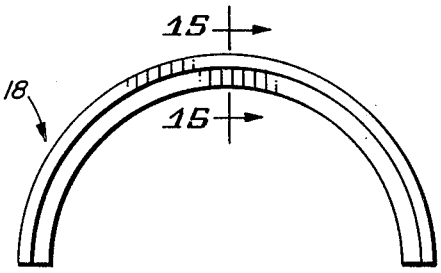
FIG. 14 is a top view of an optional seal which may be utilized in the closure member of FIG. 1.
Figure 16:
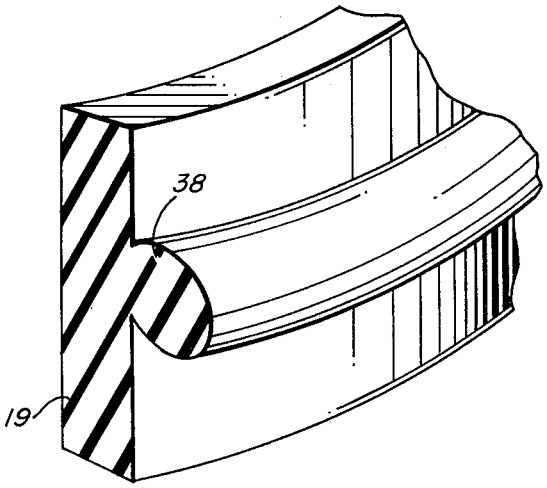
FIG. 16 is a perspective view of the seal of FIG. 8.

Bands 18, 19 may be sized and shaped to promote efficient sealing with container 11 and to specifically accomodate a container rim having particular dimensions. In FIG. 11 the ends 44, 45 of bands 18, 19 are tapered to provide a greater sealing area therebetween when bands 18, 19 are compressed against the rim of a container. As shown in FIGS. 12–15 bands 18, 19 may also be provided with L-shaped indentations 46, 47 to receive and accomodate a container rim of specific size.

In use, closure 12 is opened as shown in FIG. 2 and slid into container 11 where the uppermost surfaces 50 of container 11 receive and support panel members 13, 14. (See FIG. 8) To secure closure 12 on container 11, panel members 13 and 14 are pivoted toward one another and secured by emplacing slot 26 of substantially rigid member 28 over upstanding tooth 29 and depressing substantially rigid latch 23.

In the presently preferred embodiments of the invention the two pivoting members are easily disconnected from one another and the elastic sealing members are detachable therefrom to facilitate cleaning the closure and replacing damaged sealing elements.

Since bands 18, 19 are easily removed from collar members 15, closure 12 can be adapted to fit containers having rims of differing sizes by simply inserting elastic bands 18, 19 of the appropriate thickness in collar members 15, 16. Bands 18 in FIGS. 13 and 15 have differing thickness and could be utilized to adapt closure 12 to fit two different sized container rims. In this regard a preferred embodiment of the invention comprises a kit including the two pivoting closure members, elastic seal 30 and two pairs of resilient seals 18, 19—one pair being of greater thickness than the other. Such a kit could be quickly and conveniently assembled by relatively unskilled persons.

As would be appreciated by those skilled in the art, opposing faces 33 and 31 of panel members 13 and 14 and faces 60 and 61 of collars 15, 16 could have a wide variety of configurations (See FIGS. 6 and 7) and be sealed with any of a number of materials. The sealing material positioned between the opposing faces when the panel members are in the closed position could be secured to one of faces 31, 33, 60 and 61, to panel members 13, 14 and/or to depending collars 15, 16.

Further, a single unitary circular panel member 60 (not shown) equivalent in size and dimension to the circular panel defined by panel members 13, 14 when closure 12 is closed as in FIG. 1 could be carried by collar 15 such that when the closure 12 was open curved collar strip member 16 would not carry a panel member 14. One half of the peripheral circumference of circular panel member 60 would be attached along the inner surface of curved collar strip 15 such that panel member 60 was, as is panel member 13 in FIG. 2, essentially perpendicular to collar strip 15. The other unattached half 61 (not shown) of the peripheral circumference or edge of member 60 would be sealingly received by the inner surface of collar strip 16 when closure 12 was closed. An elastic seal along the inner surface of strip 16 could sealingly receive the outer peripheral edge 61 of member 60, or, either one or both of member 60 and collar strip 16 could be fabricated from a material which would, when edge 61 was forced against the inner surface of member 60, sealingly engage. For instance, circular panel member 60 could be fabricated from a rigid but relatively soft plastic or rubber which would form a seal when edge 61 was forced against the curved inner surface of a collar 16 fabricated from a hard, rigid plastic or metal. Such a construction would eliminate the necessity of attaching an elastic strip to the outer edge 61 of circular panel member 60.

Similarly, one or both of panel members 13, 14 could be constructed from a rigid but somewhat elastic material so that faces 31, 33 of panels 13, 14 would sealingly engage when closure 12 was closed. This would eliminate the necessity of adapting face 31 to carry elastic member 30. One or both of collar strips 15, 16 could also be comprised of a somewhat elastic material such that an effective seal would be formed when opposing ends of the strips, for instance faces 60 and 61, pressed against one another when closure 12 was closed.

Having described my invention in such terms as to enable those skilled in the art to understand and practice it, and having identified the presently preferred embodiments thereof, I claim:

1. A closure for detachably fixedly engaging and sealing an open container, said closure comprising, (a) a pair of substantially rigid members pivotally interconnected at a point on the periphery thereof for movement between at least two operative positions, (i) a closed position with said members forming a generally circular top, each member having a face adjacent to an opposing face of the other said member when said members are in said closed position, and (ii) an open position with said members rotated apart about said pivot point, (b) a projecting depending substantially rigid collar member along an outer edge of each of said pivotally connected members, said outer edges generally defining the periphery of said circular top when said pivotally connected members are in said closed position, the inner surface of each of said collar members being adapted to sealingly engage said container when said pivotally connected members are in said closed position, and (c) means for securing said pivotally connected members about said container in said closed position.

* * * * *